US009250011B2

(12) United States Patent
Berkhout et al.

(10) Patent No.: US 9,250,011 B2
(45) Date of Patent: Feb. 2, 2016

(54) ABSORPTION REFRIGERATOR WITH TEMPERATURE CONTROL

(75) Inventors: Pieter Dirk Berkhout, Dordrecht (NL); Joost Moelands, Breda (NL)

(73) Assignee: THETFORD CORPORATION, Ann Arbor, MI (US)

( * ) Notice: Subject to any disclaimer, the term of this patent is extended or adjusted under 35 U.S.C. 154(b) by 700 days.

(21) Appl. No.: 13/585,205

(22) Filed: Aug. 14, 2012

(65) Prior Publication Data

US 2013/0047649 A1 Feb. 28, 2013

Related U.S. Application Data

(60) Provisional application No. 61/527,708, filed on Aug. 26, 2011.

(51) Int. Cl.

| | |
|---|---|
| ***F25B 15/00*** | (2006.01) |
| ***F25B 15/04*** | (2006.01) |
| ***F25D 29/00*** | (2006.01) |

(52) U.S. Cl.

CPC ..... *F25D 29/00* (2013.01); *F25B 2400/01* (2013.01); *F25B 2500/31* (2013.01); *F25D 2700/10* (2013.01); *F25D 2700/12* (2013.01)

(58) Field of Classification Search

CPC . F25D 29/00; F25D 2700/10; F25D 2700/12; F25B 2400/01; F25B 2500/31

See application file for complete search history.

(56) References Cited

U.S. PATENT DOCUMENTS

| | | | | |
|---|---|---|---|---|
| 1,919,078 A | | 7/1933 | Spreen | |
| 2,153,851 A | | 4/1939 | Swedman | |
| 2,339,085 A | | 1/1944 | Lukiesh | |
| 2,663,999 A | * | 12/1953 | Alsing | F25D 11/02 62/377 |
| 2,900,802 A | | 8/1959 | Bagnall | |
| 3,612,848 A | | 10/1971 | Koch et al. | |
| 4,375,750 A | * | 3/1983 | Blomberg | F25B 15/10 62/101 |
| 4,663,941 A | | 5/1987 | Janke | |
| 4,914,919 A | * | 4/1990 | Walfridson | F25B 15/10 62/148 |
| 5,355,693 A | | 10/1994 | McConnell et al. | |
| 5,673,565 A | * | 10/1997 | Jeong et al. | 62/80 |
| 5,911,748 A | * | 6/1999 | Boxum | B60P 3/36 392/468 |
| 5,946,929 A | | 9/1999 | Selina et al. | |

(Continued)

FOREIGN PATENT DOCUMENTS

| | | |
|---|---|---|
| DE | 2055691 A1 | 5/1972 |
| DE | 3904216 A1 | 8/1990 |

(Continued)

OTHER PUBLICATIONS

Extended European Search Report regarding Patent Application No. EP12005921.7 dated Oct. 17, 2012.

(Continued)

*Primary Examiner* — Marc Norman
*Assistant Examiner* — Paolo Gonzalez
(74) *Attorney, Agent, or Firm* — Harness, Dickey & Pierce, P.L.C.; Stephen T. Olson

(57) ABSTRACT

A cooling unit constructed in accordance with one example of the present disclosure includes an outer shell that defines an interior volume. A cooling system cools the interior volume. A temperature sensor senses a temperature within the interior volume. A heating element is disposed within the interior volume. A controller communicates with the temperature sensor and the heating element and activates the heating element based on the temperature satisfying a threshold.

19 Claims, 3 Drawing Sheets

(56) References Cited

U.S. PATENT DOCUMENTS

| | | | | |
|---|---|---|---|---|
| 5,966,951 | A * | 10/1999 | Hallin et al. | 62/141 |
| 5,966,965 | A * | 10/1999 | Boxum | B60H 1/00364 62/183 |
| 6,212,902 | B1 | 4/2001 | Leistner | |
| 6,412,301 | B1 | 7/2002 | Lorek | |
| 6,662,585 | B2 | 12/2003 | Muller et al. | |
| 6,694,754 | B1 * | 2/2004 | Schenk et al. | 62/156 |
| 7,050,888 | B2 | 5/2006 | Schneider et al. | |
| 8,056,360 | B2 | 11/2011 | Unmack | |
| 2001/0047657 | A1 * | 12/2001 | Cho et al. | 62/156 |
| 2003/0131615 | A1 | 7/2003 | Collins | |
| 2004/0144128 | A1 * | 7/2004 | Junge et al. | 62/441 |
| 2005/0032012 | A1 * | 2/2005 | Eil | F23N 5/242 431/79 |
| 2005/0113982 | A1 * | 5/2005 | Schneider | F25B 49/043 700/300 |
| 2005/0115250 | A1 * | 6/2005 | Kim | 62/137 |
| 2005/0115268 | A1 * | 6/2005 | Hallin | F25D 17/045 62/407 |
| 2005/0189493 | A1 * | 9/2005 | Bagley | G01J 5/041 250/341.8 |
| 2007/0130966 | A1 * | 6/2007 | Kim et al. | 62/150 |
| 2007/0137226 | A1 * | 6/2007 | Kim et al. | 62/180 |
| 2007/0193286 | A1 | 8/2007 | Karlsson et al. | |
| 2007/0227208 | A1 | 10/2007 | Ostberg | |
| 2008/0060366 | A1 | 3/2008 | Leistner et al. | |
| 2009/0090114 | A1 * | 4/2009 | Choo | 62/80 |
| 2010/0070083 | A1 * | 3/2010 | Kim et al. | 700/275 |
| 2010/0139300 | A1 * | 6/2010 | Jeong et al. | 62/186 |

FOREIGN PATENT DOCUMENTS

| | | | |
|---|---|---|---|
| DE | 202005011279 | U1 | 9/2006 |
| EP | 0484860 | A1 | 5/1992 |
| EP | 0813034 | A2 | 12/1997 |
| EP | 0959311 | A2 | 11/1999 |
| EP | 1175586 | A1 | 1/2002 |
| EP | 1344998 | A1 | 9/2003 |
| GB | 734912 | A | 8/1955 |
| JP | 2126083 | A | 5/1990 |
| JP | 5093568 | A | 4/1993 |
| JP | 6082140 | A | 3/1994 |
| JP | 2003185336 | A | 7/2003 |
| KR | 20070062354 | A | 6/2007 |
| WO | 2006124004 | A1 | 11/2006 |
| WO | 2008025642 | A2 | 3/2008 |
| WO | 2008087028 | A2 | 7/2008 |
| WO | 2011000706 | A2 | 1/2011 |

OTHER PUBLICATIONS

Extended European Search Report regarding Application No. EP12005922.5, dated Jan. 7, 2013.

European Search Report regarding Application No. EP12005922.5, dated Dec. 20, 2012.

* cited by examiner

ABSORPTION REFRIGERATOR WITH TEMPERATURE CONTROL

CROSS-REFERENCE TO RELATED APPLICATIONS

This application claims priority to U.S. Provisional Patent Application No. 61/527,708 filed Aug. 26, 2011, which application is herein expressly incorporated by reference.

FIELD

The present disclosure relates generally to cooling systems and, more particularly, to a refrigerator and related method for controlling the temperature within an interior space of the refrigerator.

BACKGROUND

This section merely provides background information related to the present disclosure and may not constitute prior art.

Vehicles, including but not limited to, recreational vehicles ("RVs", in the United States and "Caravans" or "Mobile Homes" in Europe), tractor trailers, airplanes, boats, trains and the like, often incorporate refrigerators for the comfort and convenience of the occupants. For example, recreational vehicle campers often find it convenient, or even necessary, to refrigerate food, drinks, and medicine during their journey and while at their campsites. While many prepared camp sites in parks and commercial campgrounds provide for electrical outlets, many do not. Moreover, many highly desirable camping locations exist outside of these prepared sites. Thus, a popular solution has been to equip the recreational vehicle with an absorption refrigerator.

Absorption refrigerators typically employ heat to vaporize a coolant-water mixture (typically ammonia-water) thereby driving the refrigeration loop in a manner well known to those skilled in the art. Popular heat sources include electrical heaters and fuel burners. The fuel burners typically employ propane which is readily available at camping supply stores, barbeque supply stores, and numerous gas stations. Though, any liquid or gaseous fuel would work well and be controllable through simple, automated control systems.

Some absorption refrigerators incorporate temperature regulation control. Typically, a temperature within the refrigerator is monitored. The cooling system can be activated when a cut-in temperature is reached and de-activated when a cut-out temperature is reached. Some refrigerators may also incorporate passive defrost regulation that turns off the cooling system when an internal temperature reaches a predetermined low temperature threshold and turns on the cooling system when an internal temperature reaches a predetermined high temperature threshold. In some instances, such temperature and passive defrost regulation can inadvertently cause undesirable high internal temperatures in the refrigerator.

SUMMARY

This section provides a general summary of the disclosure, and is not a comprehensive disclosure of its full scope or all of its features.

A cooling unit constructed in accordance with one example of the present disclosure includes a cabinet that defines an interior volume. A cooling system cools the interior volume. A temperature sensor senses a temperature within the cabinet. A heating element is disposed within the interior volume. A controller communicates with the temperature sensor and the heating element and activates the heating element based on the temperature satisfying a threshold.

According to other features, the cooling system further comprises an evaporator having a fin. The temperature sensor is disposed on the fin. According to one configuration, the temperature sensor and the heating element are disposed in a common housing. The temperature sensor and the heating element are structurally combined with a potting resin and disposed in a plastic housing. The temperature sensor can comprise a thermistor. The heating element can comprise a resistor. The controller is configured to activate the heating element for a pre-determined time frame. In one example, the cooling unit is an absorption refrigerator. A method of controlling a cooling unit according to one example of the present disclosure includes sensing a temperature within a cooled interior volume of the cooling unit. Control determines if the temperature satisfies a threshold. A heating element within the cooled interior volume is activated based upon a temperature satisfying a threshold.

According to still other features, activating the heating element includes activating the heating element for a pre-selected time. Sensing the temperature comprises sensing the temperature at a pre-determined time interval. Sensing the temperature can further comprise sensing the temperature at a fin of an evaporator of a cooling system of the cooling unit.

A cooling unit constructed in accordance to another example of the present teachings includes a cabinet that defines an interior volume. A cooling system cools the interior volume. A low ambient temperature control switch is provided on the cooling unit. A heating element is disposed within the interior volume. A controller communicates with the heating element and activates the heating element at pre-determined time intervals based on the low ambient control switch being on.

According to still other features, the cooling unit further comprises a temperature sensor that senses an ambient temperature. The controller activates the heating element based on the ambient temperature. In one example, the controller is configured to activate the heating element for a first pre-determined time interval for a first ambient temperature and activate the heating element for a second pre-determined time interval for a second ambient temperature. The first pre-determined time interval is longer than the second pre-determined time interval and the second ambient temperature is larger than the first ambient temperature.

A method of controlling a cooling unit according to another example of the present disclosure includes determining if a low ambient temperature control has been selected. Control senses an ambient temperature outside of a cooled interior volume of the cooling unit. A heating element within the cooled interior volume is activated based on the sensed temperature and the low ambient temperature control being selected. In one example, activating the heating element comprises activating the heating element for a pre-selected time that is inversely proportional to the sensed temperature.

Further areas of applicability will become apparent from the description provided herein. The description and specific examples in this summary are intended for purposes of illustration only and are not intended to limit the scope of the present disclosure.

DRAWINGS

The present teachings will become more fully understood from the detailed description, any appended claims and the following drawings. The drawings are for illustrative purposes only and are not intended to limit the scope of the present disclosure.

Corresponding reference numerals indicate corresponding parts throughout the several views of the drawings.

DETAILED DESCRIPTION

Figure 1:
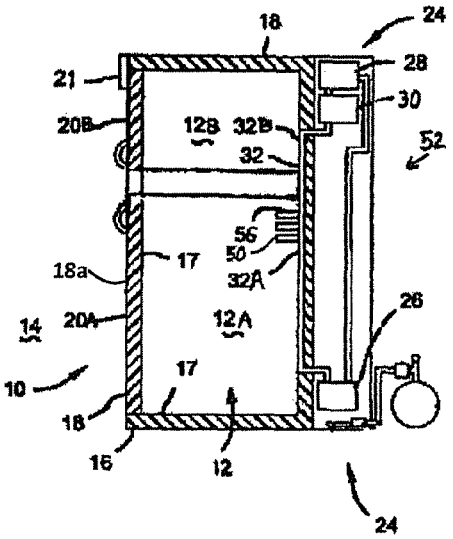
FIG. 1 is a cross-sectional side view of an absorption refrigerator incorporating a temperature control system according to the present teachings.

The following description is merely exemplary in nature and is not intended to limit the present disclosure, its application, or uses. It should be understood that throughout the drawings, corresponding reference numerals indicate like or corresponding parts and features.

The devices, methods and systems described herein can be applied to a wide variety of cooling units. For the purpose of illustration though, a typical absorption refrigeration system is used that has a cold storage compartment. Those skilled in the art will understand that the illustrative refrigeration system does not limit the present teachings in any way, but is used only to explain the present teachings.

With initial reference to FIG. 1, a cooling unit or an absorption refrigerator constructed in accordance with one example of the present teachings is shown and generally identified at reference numeral 10. The refrigerator 10 conventionally includes an interior volume 12 in which a user desires to store perishables and other items needing cooling. The interior volume 12 may be defined by a cabinet 16 that is divided into two, or more, sections 12A and 12B with one section preferentially being kept cooler than the other interior section. The cabinet 16 provides protection for the various components of the refrigerator 10. The cabinet 16 can include inner and outer liners 17 and 18, respectively that help prevent warm air intrusion into the interior 12 and prevent cold air seepage from the interior 12. The outer liner 18 can include an insulating layer 18*a* (such as fiberglass) limits heat conduction into the interior 12 from the exterior 14.

A first door 20A allows the user access to the first section 12A of the interior volume 12. A second door 20B allows the user access to the second section 12B of the interior volume 12. The doors 20A and 20B also can include a portion of the insulation 18.

Figure 2:
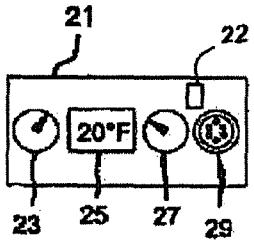
FIG. 2 is a front view of an exemplary control panel on the absorption refrigerator of FIG. 1.

With additional reference now to FIG. 2, a control panel 21 is provided on the refrigerator 10 so that the user can turn the refrigerator 10 on and off, adjust the temperature of one or more interior sections, and monitor the performance of the refrigerator 10. Controls for these functions are provided such as a low ambient temperature regulation switch 22, an on/off switch 23, a temperature indicator 25, and a temperature set point selector 27. The control panel 22 can also include a refrigeration monitor 29 to allow the user to determine whether the refrigerator is operating properly.

The refrigerator 10 also includes an absorption refrigeration system 24. As far as the present disclosure is concerned, the absorption refrigeration system 24 is conventional in construction and operation. Briefly, the absorption system 24 includes a generator 26, a condenser 28, a receiver 30, and an evaporator 32 arranged in a loop. In the generator 26, the coolant mixture (typically ammonia and water-anhydrous ammonia) absorbs heat thereby preferentially releasing ammonia vapor. From the generator 26, the ammonia vapor flows to the condenser 28. In the condenser 28, the ammonia vapor cools and condenses. Outside air driven by a fan may be employed to provide the heat transfer necessary to condense the vapor in the condenser 28. By gravity, the cool liquid ammonia flows from the condenser 28 and into the receiver 30.

From the receiver 30, the liquid ammonia bleeds through an orifice (not shown) into the evaporator 32. In the evaporator 32, the liquid ammonia absorbs heat from the interior 12 thereby cooling the interior 12. The flow of ammonia to the evaporator 32 may be controlled by a control valve rather than the orifice described above, thus providing closed loop control of the temperature in the interior 12. The vaporized ammonia then flows from the evaporator 32 to the generator 26 wherein the partially depleted water-ammonia mixture absorbs the ammonia vapor to complete the refrigeration cycle. The evaporator 32 may include one or more cooling fins 50 for increasing the efficiency of removing heat from the interior volume 12. Other arrangements of the evaporator 32 may be provided without departing from the present disclosure. Additional description of components and operation of the absorption refrigeration system 24 may be found in U.S. Pat. No. 7,050,888, which is expressly incorporated herein by reference.

Figure 3:
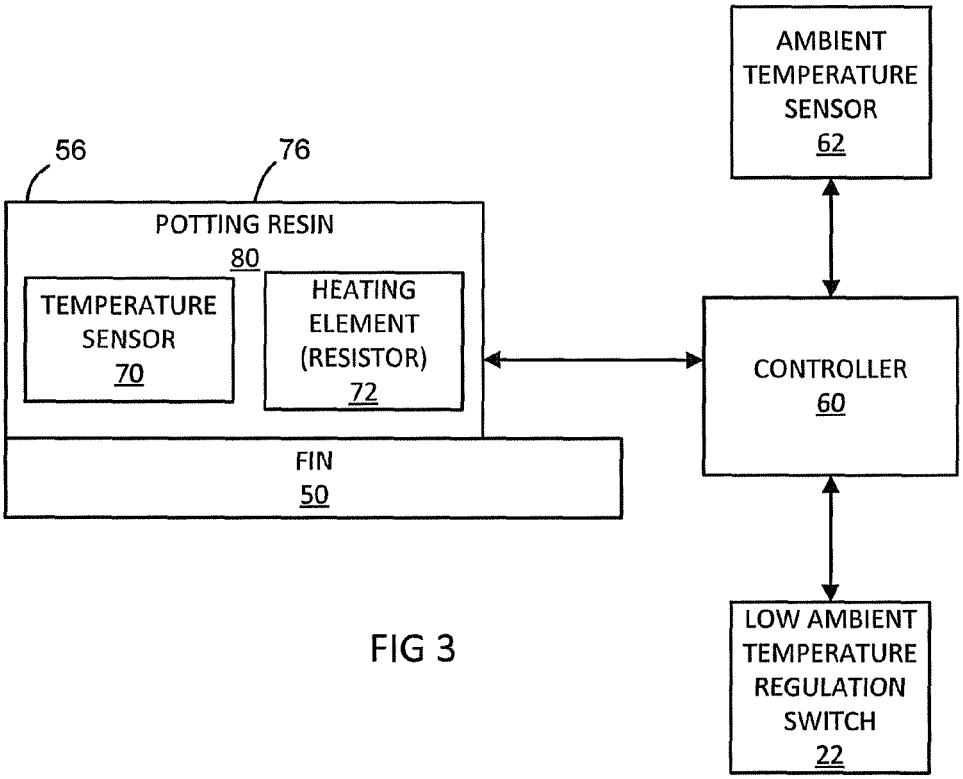
FIG. 3 is a functional block diagram of the temperature control system according to one example of the present disclosure.

With continued reference now to FIGS. 1 and 2 and additional reference to FIG. 3, additional features of the refrigeration system 24 will be described. The refrigeration system 24 includes a temperature control system 52 that is configured to provide a low ambient temperature regulation and an active defrost regulation as will be described more fully herein. The temperature control system 52 generally includes a circuit assembly 56, a controller 60, an ambient temperature sensor 62, and the low ambient temperature regulation switch 22. In one example, the circuit assembly 56 comprises a temperature sensor 70 and a heating element 72. The temperature sensor 70 may be a thermocouple, a thermistor, a resistance thermal detector (RTD), or any other temperature sensing device that is well-known in the art. The heating element 72 can be a resistor or other component configured to generate heat. The circuit assembly 56 according to the examples shown herein incorporates a housing 76 that collectively houses both of the temperature sensor 70 and the heating element 72. Potting resin 80 can be incorporated in the housing 76 to structurally combine both of the temperature sensor 70 and the heating element 72 in a common structure. In one example, the housing 76 can be a plastic component. Other configurations and materials are contemplated. Furthermore, it will be appreciated that while the temperature sensor 70 and the heating element 72 have been shown and described herein as formed in a common component, they may be positioned separate from each other within the interior 12 of the refrigerator 10. Nevertheless, in the example shown, the circuit assembly 56 is disposed on a fin 50 of the evaporator 32. The temperature sensor 70 is configured to communicate a signal to the controller 60 indicative of a temperature measured at the fin 50 or, more generally, within the interior 12 of the refrigerator 10. The controller 60 is configured to communicate a signal to the heating element 72 to activate the heating element 72 when certain conditions are met as will be discussed herein.

Figure 4:
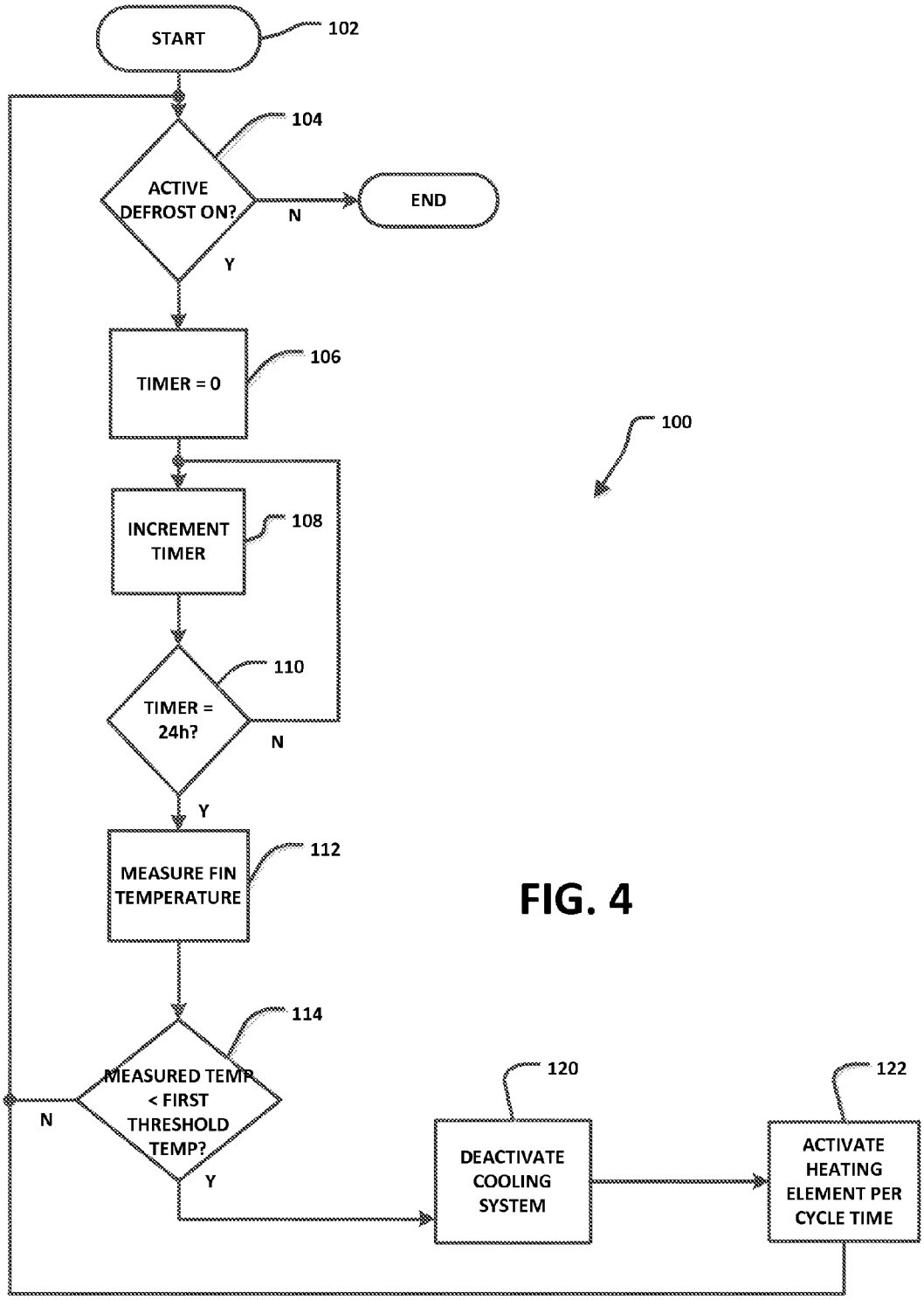
FIG. 4 is a flow-chart illustrating an active defrost regulation control in accordance to one example of the present teachings.

With additional reference now to FIG. 4, an exemplary method 100 of performing active defrost regulation according to one example of the present teachings will be described. The method begins in step 102. In step 104, control determines if active defrost regulation is on. Active defrost regulation can also be referred to as a Forced Defrost System (FDS). Active defrost can be configured to automatically be on or alternatively, can be selectively turned on by a user, such as with a switch. If control determines that active defrost is not on in step 104, control ends in step 106. If control determines that active defrost is on in step 104, control sets a timer to zero in step 106. In step 108, control increments the timer. In step 110, control determines if the timer has reached 24 hours. It will be appreciated that the timeframe of 24 hours is merely exemplary and other timeframes may be used. If the controller has determined that the timer has not reached 24 hours, control loops to step 108.

If control has determined that the timer has reached 24 hours in step 110, control measures the fin temperature in step 112. As discussed above, the fin temperature may be measured such as by way of the temperature sensor 70 communicating a signal to the controller 60. In step 114, control determines if the measured temperature is less than a first threshold temperature. If the measured temperature is not less than the first threshold temperature in step 114, control loops to step 104. If the measured temperature is less than the threshold temperature, control de-activates the cooling system 24 in step 120. Control then activates the heating element 72 in step 122. Control then loops to step 104. In step 122, control can activate the heating element 72 according to a pre-determined cycle time. In one example, the heating element 72 can be activated for five minutes. Other timeframes are contemplated. By activating the heating element 72, the resulting heat can assist in defrosting the fins 50. Furthermore, the added heat can increase the percentage of "on" time of the cooling system 24. The added "on" time of the cooling system 24 can promote lower temperatures within the interior volume 12 of the refrigerator 10.

Figure 5:
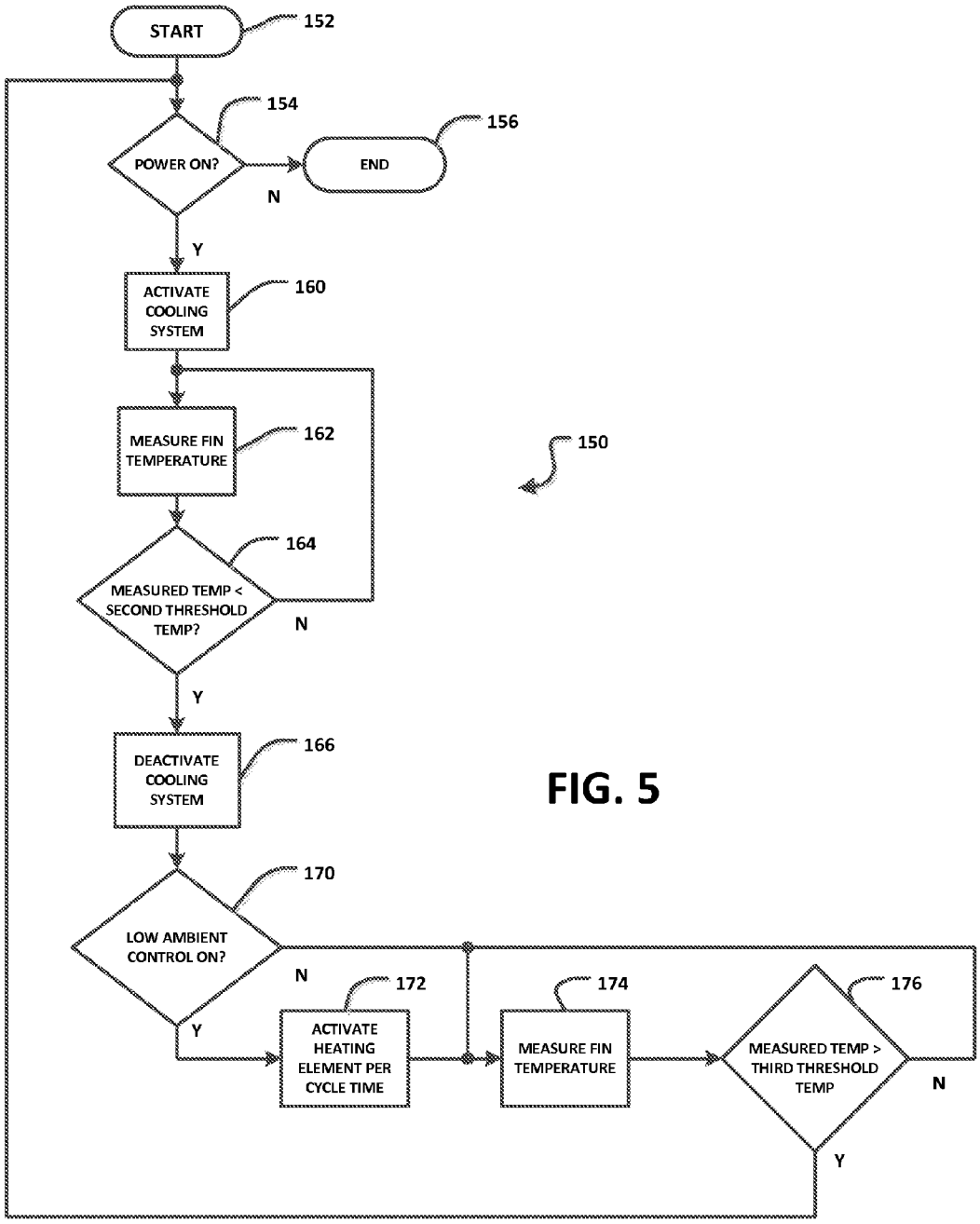
FIG. 5 is a flow chart illustrating low ambient temperature regulation control according to one example of the present teachings.

With reference now to FIG. 5, an exemplary method 150 for performing a low ambient temperature regulation according to one example of the present teachings will be described. Control begins in step 152. In step 154, control determines if power is on. If power is not on, control ends in step 156. If control determines that power is on in step 154, control activates the cooling system 24 in step 160. In step 162, the temperature of the fin 50 is measured with the temperature sensor 70. In step 164, control determines if the measured temperature is less than a second threshold temperature. If control determines that the measured temperature is not less than the second threshold temperature, control loops to step 162. If control determines that the measured temperature is less than the second threshold temperature in step 164, control de-activates the cooling system 24 in step 166.

In step 170, control determines if low ambient control is on. In one example, low ambient control can be switched on by way of the low ambient control switch 22. If low ambient control is not on in step 170, control loops to step 174, where the temperature of the fin 50 is measured. If the low ambient control is on in step 170, control activates the heating element 72 for the pre-determined cycle time in step 172. The pre-determined cycle time can include an "on" time of five minutes every twenty minutes. Other timeframes and frequencies are contemplated. In other examples, the "on" time for the heating element 72 can be adjusted based on an ambient temperature sensor 62. A lower ambient temperature can result in an increased activation time of the heating element 72.

In step 176, control determines if the measured temperature is greater than a third threshold temperature. If the measured temperature is not greater than the third threshold temperature, control loops to step 174. If the measured temperature is greater than the threshold temperature in step 176, control loops to step 154. It will be appreciated that while the method 100 for controlling active defrost regulation and the method 150 for controlling a low ambient temperature regulation have been described separately, they may be carried out concurrently.

Accordingly, an absorption refrigerator 10 is provided that is particularly adapted to actively control defrosting under low ambient temperature conditions. In this regard, the refrigeration system 24 incorporates an advanced temperature control comprising the combined temperature sensor (thermistor) 70 and heating element (resistor) 72 controlled by the controller 60. The resistor 72, when activated will generate heat to increase the percentage "on" time and/or to defrost the fins 50 in relatively short time. This will allow sufficient low temperature in the interior volume 12 during particular operating conditions. Two particularly unfavorable operating conditions can be avoided with the advanced temperature control of the present disclosure. One unfavorable operating condition can create a relatively long "off" time of the refrigeration system 24 creating high temperatures in the low temperature compartment 12B of the interior volume 12. This can occur in low ambient temperatures (such as below 10 degrees Celsius). In such conditions, there is relatively little cooling power needed to achieve the desired set temperature in the cabinet 16. As a result the amount of "on" time is limited. As a direct result, the low temperature compartment 12B reaches unacceptable high temperatures.

Another particularly unfavorable operating condition that can be avoided with the advanced temperature control of the present disclosure is again an operating condition can create a relatively long "off" time of the refrigeration system 24 creating high temperatures in the interior volume 12. This operating condition can be caused by a relatively large build-up of ice on the fins 50. The time needed to passively defrost the ice can take several hours and this time will increase at lower ambient temperatures. As a direct result, the interior volume 12 reaches unacceptable high temperatures. The low temperature compartment 12B will be more adversely effected than the higher temperature compartment 12A.

While specific examples have been discussed in the specification and illustrated in the drawings, it will be understood by those skilled in the art that various changes may be made and equivalence may be substituted for elements thereof without departing from the scope of the present teachings. Furthermore, the mixing and matching of features, elements and/or functions between various examples may be expressly contemplated herein so that one skilled in the art would appreciate from the present teachings that features, elements and/or functions of one example may be incorporated into another example as appropriate, unless discussed otherwise above. Moreover, many modifications may be made to adapt a particular situation or material to the present teachings without departing from the essential scope thereof. Therefore, it may be intended that the present teachings not be limited to the particular examples illustrated by the drawings and discussed in the specification as the best mode of presently contemplated for carrying out the present teachings but that the scope of the present disclosure will include any embodiments following within the foregoing description and any appended claims.

What is claimed is:

1. A cooling unit comprising:

a cabinet that defines an interior volume;

a cooling system that cools the interior volume, the cooling system including an evaporator;

a temperature sensor that senses a temperature within the interior volume;

a heating element disposed within the interior volume and operably associated with the evaporator; and a controller that communicates with the temperature sensor and the heating element, wherein the controller activates the heating element based on the temperature satisfying a threshold; and wherein the controller further implements a low ambient temperature regulation control scheme by controlling the heater in accordance with the sensed temperature and during low ambient temperature conditions, to thus heat the evaporator, and as a result to cause the cooling system to provide cooling under low ambient temperature conditions where the cooling system would otherwise not provide sufficient cooling to cool the interior volume of the cabinet.

2. The cooling unit of claim 1 wherein the evaporator comprises a fin, and the heating element is operably associated with the fin.

3. The cooling unit of claim 2 wherein the temperature sensor is disposed on the fin.

4. The cooling unit of claim 1 wherein the temperature sensor and the heating element are disposed in a common housing.

5. The cooling unit of claim 4 wherein the temperature sensor and the heating element are structurally combined with a potting resin and disposed in a plastic housing.

6. The cooling unit of claim 1 wherein the temperature sensor comprises a thermistor.

7. The cooling unit of claim 1 wherein the heating element comprises a resistor.

8. The cooling unit of claim 1 wherein the controller is configured to activate the heating element for a predetermined timeframe.

9. The cooling unit of claim 1 wherein the cooling unit is an absorption refrigerator.

10. A method of controlling a cooling unit, wherein the cooling unit includes a cooling system having an evaporator, the method comprising:

using a temperature sensor to sense a temperature within a cooled interior volume of the cooling unit;

using a controller to read the sensed temperature and to determine if the sensed temperature satisfies a threshold;

using the controller to activate a heating element operably associated with the evaporator and positioned within the cooled interior volume, and based on the sensed temperature satisfying a threshold; and further using the controller to implement a user selectable low ambient temperature regulation control scheme by controlling the heating element in accordance with a sensed ambient temperature around the cooling unit, and during low ambient temperature conditions to heat the evaporator, and as a result to cause the cooling system to provide cooling under the low ambient temperature conditions where the cooling system would otherwise not provide sufficient cooling to cool the cooled interior volume of the cooling unit.

11. The method of claim 10 wherein activating the heating element comprises activating the heating element for a pre-selected time.

12. The method of claim 10 wherein sensing the temperature comprises sensing the temperature at a pre-determined time interval.

13. The method of claim 10 wherein sensing the temperature further comprises sensing the temperature at a fin of the evaporator of the cooling system of the cooling unit.

14. A cooling unit comprising:

an outer shell that defines an interior volume;

a cooling system having an evaporator, the cooling system operable to cool the interior volume;

a low ambient temperature control switch;

a heating element operably associated with the evaporator, and being disposed within the interior volume;

a controller that communicates with the heating element, wherein the controller activates a low ambient temperature regulation control scheme by activating the heating element at predetermined time intervals based on the low ambient control switch being on; and wherein while performing the low ambient temperature regulation control scheme, the controller uses the heating element to heat the evaporator, and as a result to cause the cooling system to provide cooling under low ambient temperature conditions where the cooling system would otherwise not provide sufficient cooling to cool the interior volume of the cooling unit.

15. The cooling unit of claim 14, further comprising:

a temperature sensor that senses an ambient temperature;

wherein the controller further activates the heating element based on the sensed ambient temperature.

16. The cooling unit of claim 15 wherein the controller activates the heating element for a first predetermined time interval for a first ambient temperature and activates the heating element for a second predetermined time interval for a second ambient temperature, wherein the first predetermined time interval is larger than the second predetermined time interval and wherein the second ambient temperature is larger than the first ambient temperature.

17. A method of controlling a cooling unit having a cooling system, wherein the cooling system has an evaporator, the method comprising:

determining if a low ambient temperature control scheme has been selected; and using a temperature sensor to sense an ambient temperature outside of a cooled interior volume of the cooling unit;

when the low ambient temperature control scheme has been selected, using a controller to activate a heating element operably associated with the evaporator, and disposed within the cooled interior volume; and using the controller to control the heating element in accordance with the sensed ambient temperature and to heat the evaporator, and as a result to cause the cooling system to provide cooling under low ambient temperature conditions where the cooling system would otherwise not provide sufficient cooling to cool the cooled interior volume of the cooling unit.

18. The method of claim 17 wherein activating the heating element comprises activating the heating element for a pre-selected time.

19. The method of claim 18 wherein the pre-selected time is inversely proportional to the sensed temperature.

* * * * *